US006223610B1

(12) United States Patent
Ishiguro et al.

(10) Patent No.: US 6,223,610 B1
(45) Date of Patent: May 1, 2001

(54) DIAL OPERATING DEVICE

(75) Inventors: Kazuyoshi Ishiguro; Mitsuru Naka, both of Niwa-gun (JP)

(73) Assignee: Kabushiki Kaisha Tokai Rika Denki Seisakusho, Aichi (JP)

( * ) Notice: Subject to any disclaimer, the term of this patent is extended or adjusted under 35 U.S.C. 154(b) by 0 days.

(21) Appl. No.: 09/284,442

(22) PCT Filed: Oct. 15, 1997

(86) PCT No.: PCT/JP97/03849

§ 371 Date: Apr. 14, 1999

§ 102(e) Date: Apr. 14, 1999

(87) PCT Pub. No.: WO98/16941

PCT Pub. Date: Apr. 23, 1998

(30) Foreign Application Priority Data

Oct. 15, 1996 (JP) ..... 8-272432

(51) Int. Cl.[7] ..... G05G 5/03; G05G 5/06

(52) U.S. Cl. ..... 74/10.41; 74/527

(58) Field of Search ..... 74/10.41, 527; 200/565, 569

(56) References Cited

U.S. PATENT DOCUMENTS

| | | | | |
|---|---|---|---|---|
| 2,747,037 | * | 5/1956 | Watson | 74/527 |
| 3,260,805 | * | 7/1966 | Pihl | 74/527 X |
| 3,952,365 | * | 4/1976 | Grisebach | 16/52 |
| 4,613,020 | * | 9/1986 | Deem et al. | 74/527 X |
| 5,589,671 | * | 12/1996 | Hackbarth et al. | 74/527 X |

FOREIGN PATENT DOCUMENTS

| | | |
|---|---|---|
| 59-63901 | 4/1984 | (JP) . |
| 4-98725 | 3/1992 | (JP) . |

* cited by examiner

*Primary Examiner*—Allan D. Herrmann
(74) *Attorney, Agent, or Firm*—Morgan, Lewis & Bockius LLP

(57) ABSTRACT

When a leaf spring 22 is rotated integrally with the rotation of a knob dial 18, the leaf spring 22 is pushed and deflected by three corners of a cylindrical section 17*a*. After that, when three corners of the cylindrical section 17*a* get over the leaf spring 22 and new three surfaces are engaged with the leaf spring 22, rotation of the knob dial 18 is regulated. In this case, the pushing direction of the leaf spring 22 is the same as the direction of deflection. Therefore, the rotational resistance of the knob dial 18 can be reduced. Accordingly, a feeling of operation of the knob dial 18 becomes light.

4 Claims, 7 Drawing Sheets

DIAL OPERATING DEVICE

BACKGROUND OF THE INVENTION

1. Technical Field of the Invention

The present invention relates to a dial operation device having a knob dial to be rotated for operation.

2. Technical Background

FIGS. 7 and 8 are views showing a conventional structure of the above dial operation device. In this structure, there is provided a printed wiring board 1, onto which a support 2*a* of a knob base 2 is attached by screws. On an outer circumferential surface of the knob base 2, a knob dial 3 is pivotally engaged. A knob body 4 is engaged on an inner circumferential surface of the knob dial 3. Therefore, when the knob dial 3 is rotated for operation, the knob body 4 is rotated integrally with the knob dial 3.

In the knob body 4, there is formed a moderation surface 4*a*. Engaging pieces 5, 5 are attached to the support 2*a* of the knob base 2. Both engaging pieces 5 are pushed by a compression spring 6. Therefore, both engaging pieces 5 can be engaged with recesses formed on the moderation surface 4*a*. Accordingly, when the knob dial 3 is rotated for operation, both engaging pieces 5 are pushed by protrusions formed on the moderation surface 4*a* and retracted into the support 2*a*. After that, they are protruded by a spring force of the compression spring 6 and engaged in the recesses on the moderation surface 4*a*. Due to the foregoing, a rotary position of the knob dial 3 can be regulated, and it is possible to provide a feeling of moderation in the rotary operation of the knob dial 3.

However, in the above conventional structure, the direction of deflection of the compression spring 6, that is, a moving direction of the engaging piece 5 is different from the pushing direction. Therefore, when both engaging pieces 5 are pushed into the supports 2*a*, it is necessary to rotate the knob dial 3 with a relatively strong force. Accordingly, there is a tendency that an operator feels high resistance in the operation of the knob dial 3. Further, both engaging pieces 5 are kept in a condition in which they are pushed by the protrusions on the moderation surface 4*a*. Therefore, the operation feeling at an intermediate position of the knob dial 3 grows too heavy.

SUMMARY OF THE INVENTION

The present invention has been accomplished in view of the above circumstances. It is an object of the present invention to provide a dial operation device, the operation feeling of the knob dial of which is light.

A dial operation device described in claim 1 comprises: a knob dial to be rotated for operation; a moderation member to be relatively rotated in accordance with the rotation of the knob dial; and a spring member to be relatively rotated in accordance with the rotation of the knob dial, wherein a section of the moderation member is polygonal, and the spring member is composed of a leaf spring for regulating the rotation of the knob dial when the spring member is engaged with at least one surface of the moderation member.

According to the above means, when the knob dial is rotated for operation, the moderation member and the leaf spring are relatively rotated, and the leaf spring is pushed and deflected by a corner of the moderation member. After that, the leaf spring is engaged with a new surface. Due to the foregoing, a rotary position of the knob dial is regulated, and at the same time a feeling of moderation can be provided in the rotary operation. In this case, since the pushing direction of the leaf spring is the same as the deflecting direction, the rotary resistance of the knob dial can be reduced, and the operation feeling of the knob dial becomes light. Especially, it is possible to prevent a feeling of operation at an intermediate position from growing heavy.

A dial operation device described in claim 2 comprises: a knob dial to be rotated for operation;

a moderation member to be relatively rotated in accordance with the rotation of the knob dial; and a spring member to be relatively rotated in accordance with the rotation of the knob dial, wherein a cross-section of the moderation member is polygonal, and the spring member is composed of a wire spring for regulating the rotation of the knob dial when the spring member is engaged with at least one surface of the moderation member.

According to the above means, when the knob dial is rotated for operation, the moderation member and the wire spring are relatively rotated, and the wire spring is pushed and deflected by a corner of the moderation member. After that, the wire spring is engaged with a new surface. Due to the foregoing, a rotary position of the knob dial is regulated, and at the same time a feeling of moderation can be provided in the rotary operation. In this case, since the pushing direction of the wire spring is the same as the deflecting direction, the feeling of operation of the knob dial becomes light. Especially, it is possible to prevent a feeling of operation at an intermediate position from growing heavy.

A dial operation device described in claim 3 comprises: a plurality of knob dials to be rotated for operation; a plurality of moderation members to be relatively rotated in accordance with the rotation of the plurality of knob dials; and a plurality of spring members to be relatively rotated in accordance with the rotation of the knob dials, wherein cross-sections of the plurality of moderation members are polygonal, and the plurality of spring members are composed of wire springs, the numbers of which are different from each other, for regulating the rotation of the knob dials when the spring members are engaged with at least one surface of the moderation members.

According to the above means, when each knob dial is rotated for operation, the moderation member and the wire spring in each set are relatively rotated, and each wire spring is pushed and deflected by a corner of the moderation member. After that, the wire spring is engaged with a new surface. Due to the foregoing, a rotary position of the knob dial is regulated, and at the same time a feeling of moderation can be provided in the rotary operation. In this case, since the pushing direction of the wire spring is the same as the deflecting direction, the feeling of operation of the knob dial becomes light. Especially, it is possible to prevent a feeling of operation at an intermediate position from growing heavy. Further, wire springs of different numbers are used for a plurality of knob dials, and operation forces of the plurality of knob dials are different from each other. Therefore, it is possible to easily distinguish between the plurality of knob dials by the difference in the operation feeling.

BRIEF DESCRIPTION OF THE DRAWINGS

FIG. 1 is a front surface view showing a heater controller;

THE MOST PREFERRED EMBODIMENT OF THE PRESENT INVENTION

Figure 1:
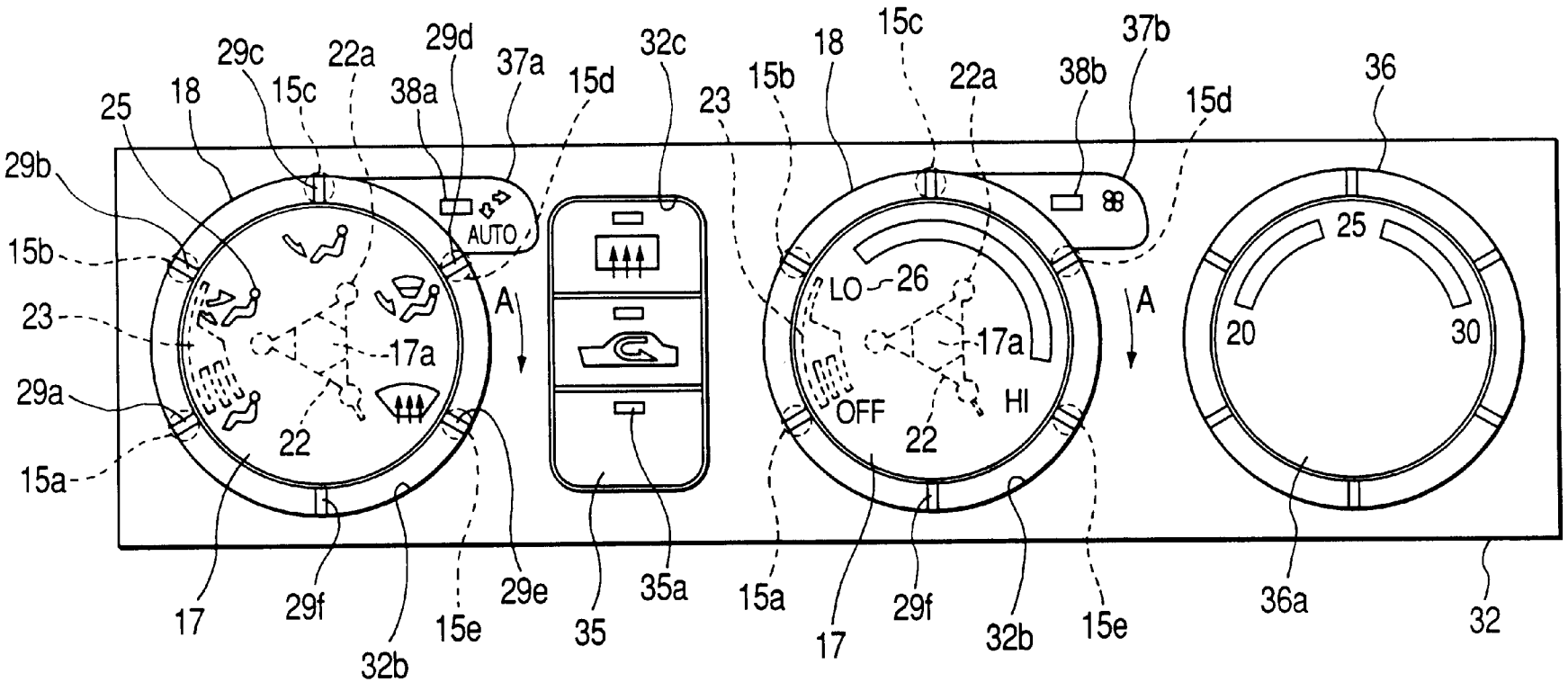
FIG. 1 is a view showing a first embodiment of the present invention, that is.
Figure 2:
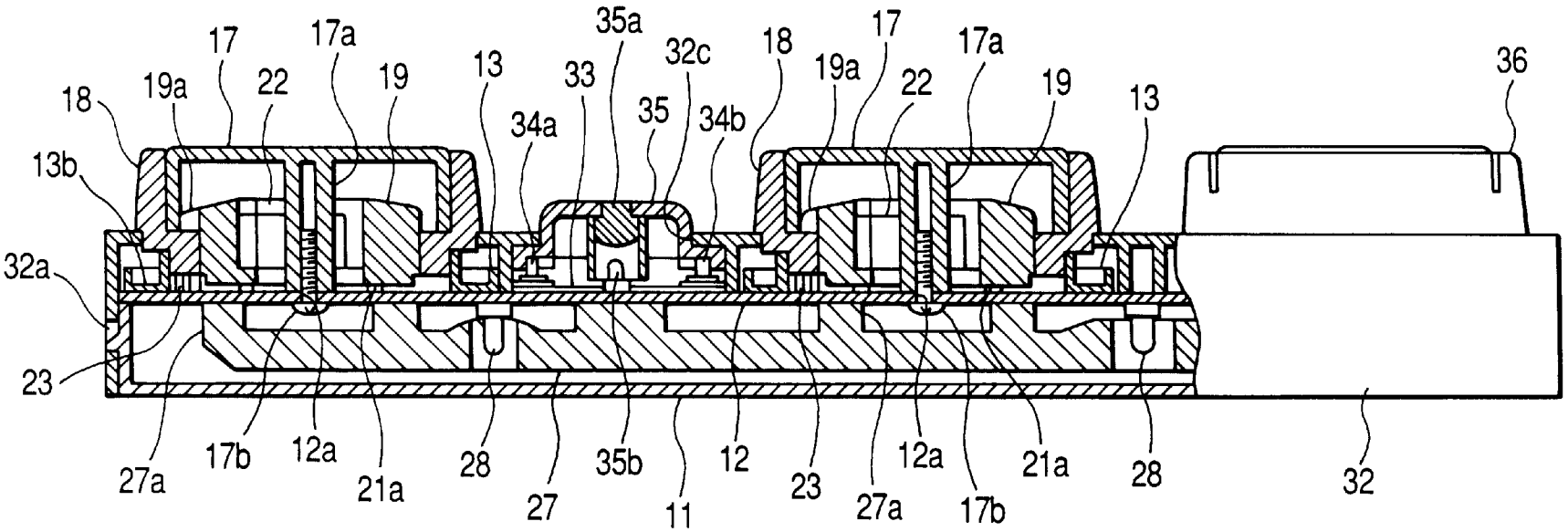
FIG. 2 is a transversely cross-sectional view showing the heater controller.

Referring to FIGS. 1 to 5, the first embodiment of the present invention will be explained as follows. In this connection, this embodiment is a case in which the present invention is applied to a heater controller of an automobile, and this heater controller is attached onto an instrument panel of the automobile. As shown in FIG. 2, there is provided a bezel 32 made of synthetic resin. This bezel 32 is formed into a rectangular box-shape, the rear surface of which is open. A printed wiring board 12 is attached to the bezel 32 with screws, and a rear opening of the bezel 32 is covered with a printed wiring board 12 and a cover 11.

Figure 4:
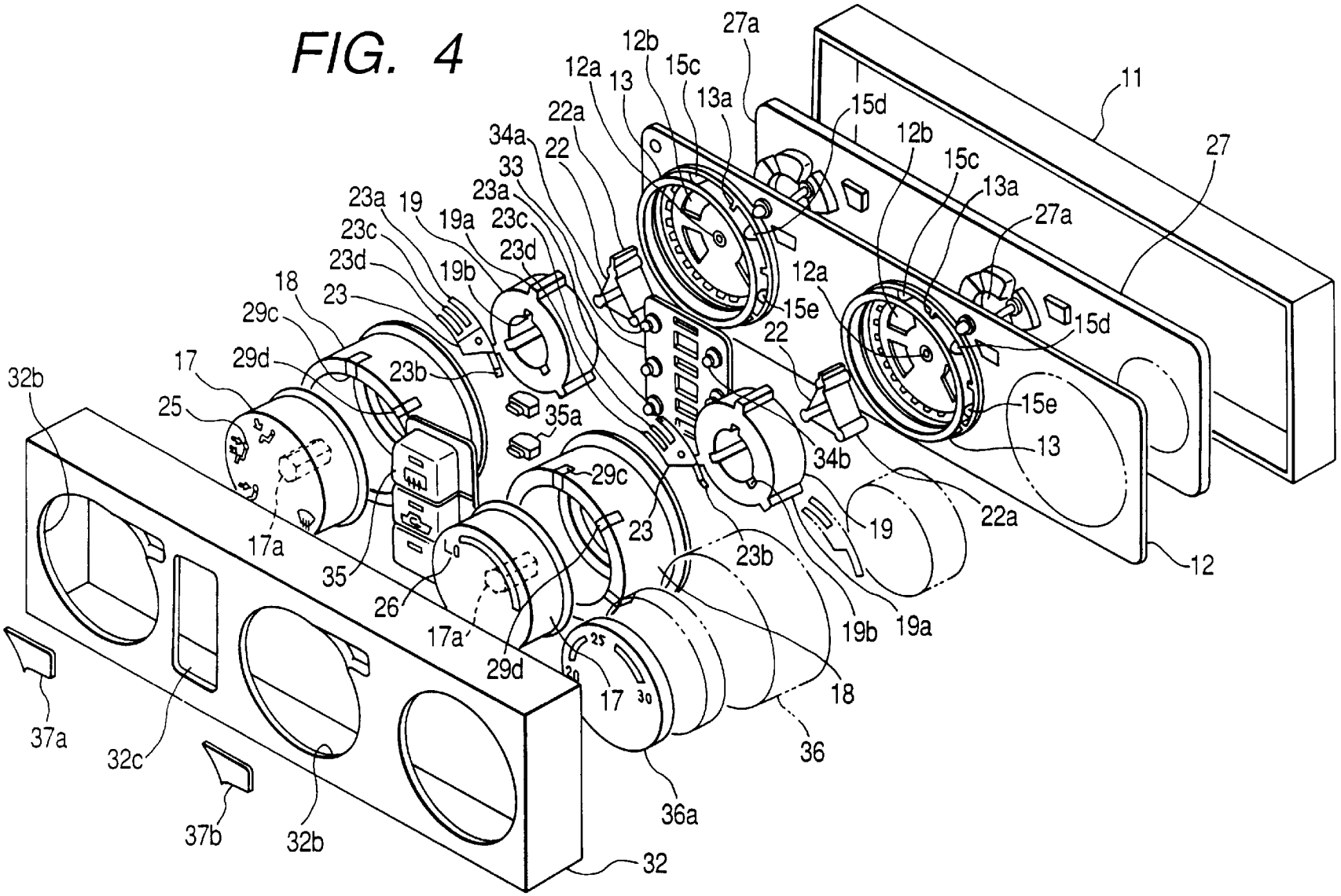
FIG. 4 is an exploded perspective view showing the heater controller.
Figure 5:
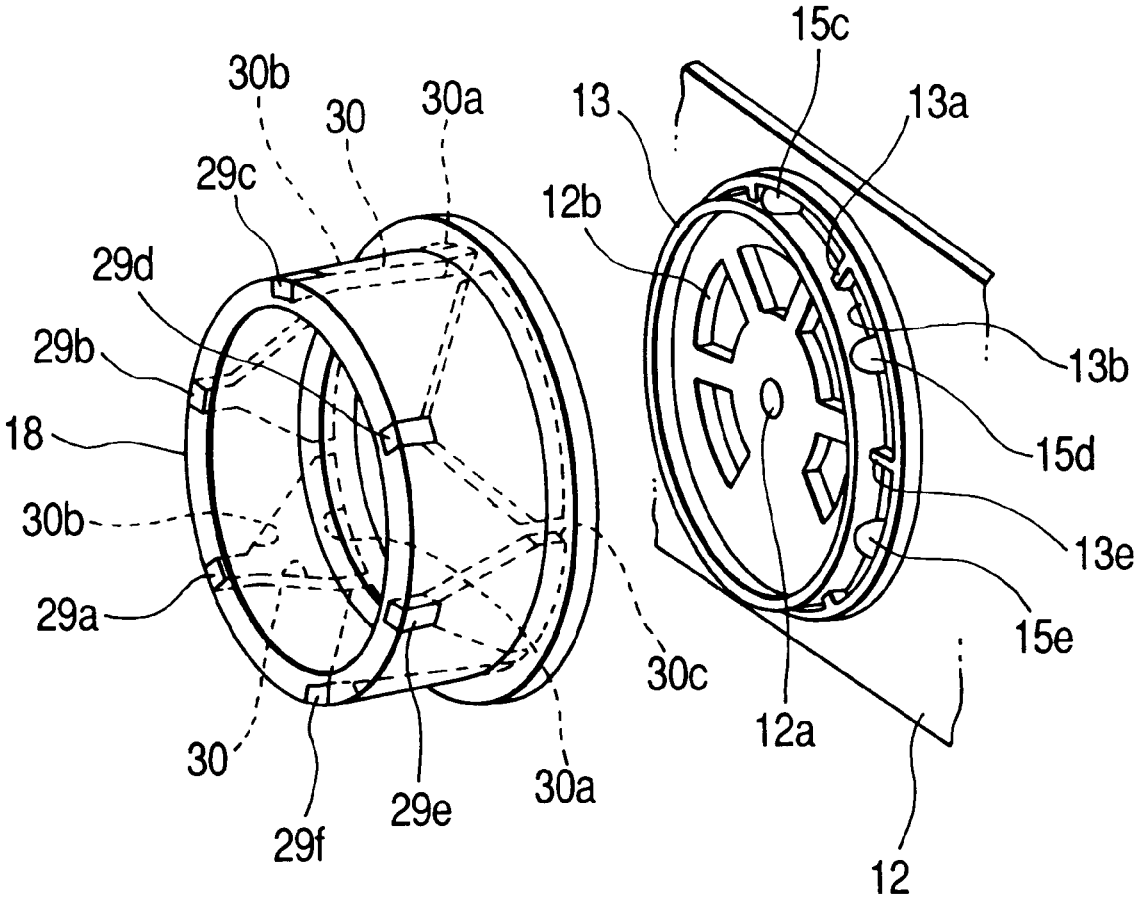
FIG. 5 is a perspective view showing a knob dial.

As shown in FIG. 4, holders 13, 13 made of synthetic resin are attached onto the front surface of the printed wiring board 12. An shown in FIG. 5, each holder 13 has six partition walls 13*a* which are integrated with the holder 13. Only four partition walls 13*a* are shown in FIG. 5. Between the partition walls 13*a*, there is formed an LED accommodating section 13*b*.

Figure 3:
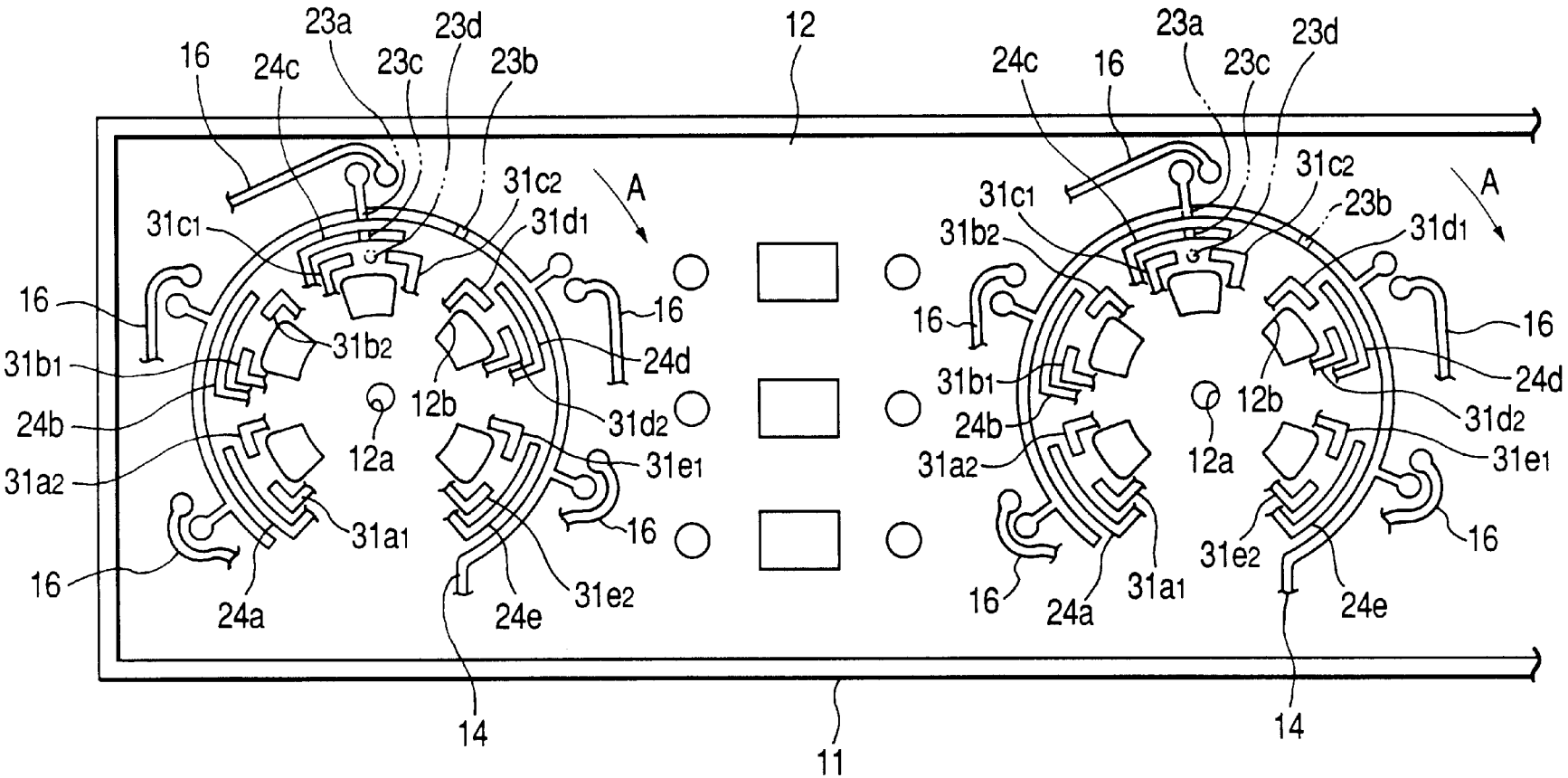
FIG. 3 is a front surface view showing a printed wiring board.

As shown in FIG. 3, two common circuit patterns 14, which are formed into an arc-shape, are formed on the front surface of the printed wiring board 12. As shown in FIGS. 1 and 4, LEDs 15*a* to 15*e* corresponding to light sources are accommodated in five LED accommodating sections 13*b* of each holder 13. one of the terminals of each LED is connected to the common circuit pattern 14.

As shown in FIG. 3, on the front surface of the printed wiring board 12, there are provided five power source circuit patterns 16 which are located in an outer circumferential section of each common circuit pattern 14. The other terminal of each LED is connected to the power source pattern 16. Electricity is supplied to LEDs 15*a* to 15*e* via the common circuit pattern 14 and the power source circuit pattern 16.

Knob bases 17, 17 shown in FIG. 4 are made of synthetic resin. A cylindrical section 17*a* is integrally formed in each knob base 17. Each cylindrical section 17*a* corresponds to a moderation member and has a hexagonal cross-section as shown in FIG. 1. As shown in FIG. 2, there is formed a hole 12*a* at the center of the holder 13 on each printed wiring board 12. A screw is inserted into the hole 12*a* from the rear side. This screw 17*b* is screwed into the cylindrical section 17*a*. Due to the foregoing, the knob bases 17, 17 are fixed onto the printed wiring board 12.

As shown in FIG. 4, a substantially cylindrical knob dial 18 made of synthetic resin is pivotally engaged on an outer circumferential surface of each knob base 17. On an inner circumferential surface of the knob dial 18, there are formed three grooves not shown in the drawing. In the knob dial 18, there is accommodated a cylindrical knob body 19 made of synthetic resin.

On an outer circumferential surface of the knob body 19, three protrusions 19*a* are integrally formed as shown in FIG. 4. The three protrusions 19*a* of the knob body 19 are engaged with the grooves of the knob dial 18. Therefore, when the knob dial 18 is rotated for operation, torque is transmitted to the knob body 19 via the three protrusions 19*a*, and the knob body 19 is integrally rotated. In this connection, as shown in FIG. 2, a plurality of spherical sections 21*a* are formed on a lower surface of each knob dial 18 and on a lower surface of each knob body 19. Due to the above structure, when each knob dial 18 is rotated for operation, the plurality of spherical sections 21*a* slide on the printed wiring board 12.

As shown in FIG. 1, a leaf spring 22 corresponding to the spring member is accommodated in each knob body 19. Each leaf spring 22 is bent and formed into a triangle. In each leaf spring 22, there are formed three engaging sections 22*a*. As shown in FIG. 4, there are formed three grooves 19*b* on an inner circumferential surface of each knob body 19. The engaging sections 22*a* of the leaf spring 22 are inserted into the three grooves 19*b* of each knob body 19. Due to the above structure, when each knob dial 18 is rotated for operation, the leaf spring 22 is rotated integrally with the knob body 19.

As shown in FIG. 1, three surfaces of each leaf spring 22 come into surface-contact with predetermined three surfaces of the cylindrical section 17*a*. Therefore, when each knob dial 18 is rotated and the leaf spring 22 is operated according to the rotation of the knob dial 18, the leaf spring 22 is pushed and deflected by three corners of the cylindrical section 17*a*. After that, the three corners of each cylindrical section 17*a* get over the leaf spring 22 and engage with three new surfaces, so that the rotation of each knob dial 18 can be regulated again. Accordingly, each knob dial 18 can be positioned at the interval of 60°. Further, each time the corners of the cylindrical section 17*a* get over the leaf spring 22 at the interval of 60°, it is possible to provide a feeling of moderation.

As shown in FIG. 2, a contact 23 located on the outer circumference is screwed onto a rear surface of each knob dial 18. As shown in FIG. 4, each contact 23 has contact points 23*a* to 23*d*. The contact points 23*a*, 23*b* on the outer circumferential side come into contact with the common circuit pattern 14, the shape of which is an arc.

On the front surface of the printed wiring board 12, there are provided first detection circuit patterns 24*a* to 24*e* which are located on the inner circumferential section of each common circuit pattern 14. When each knob dial 18 is rotated for operation, the contact point 23*c* of each contact 23 comes into the detection circuit pattern 24*a* to 24*e* according to the rotational position of the knob dial 18. Due to the foregoing, the predetermined detection circuit pattern 24*a* to 24*e* can be selectively continued to the common circuit pattern 14, and a continuation signal is outputted from the predetermined detection circuit pattern 24*a* to 24*e*. In this connection, the contact point 23*b* of each contact 23 is a dummy contact point which is provided for adjusting the mechanical balance.

An ECU (not shown) corresponding to a control unit is mounted on an automobile. This ECU is mainly composed of a microcomputer and operated as follows. A rotational position of each knob dial 18 is detected according to the detection circuit pattern 24*a* to 24*e* from which a continuation signal is outputted. A hot air or cold air blowing position of air control is changed over according to a rotational position of the knob dial located on the left, and a quantity of blowing control air is changed over according to a rotational position of the knob dial 18 located on the right. At the same time, electricity is supplied to a predetermined LED 15*a* to 15*e* via the common circuit pattern 14 and the power supply circuit pattern 16, so that light can be emitted from the predetermined LED 15*a* to 15*e*.

As shown in FIG. 1, there are provided a plurality of marks 25 indicating a blowing position of hot air on the front surface of the knob base 17 located on the left, and there are provided a plurality of marks 26 indicating a quantity of blowing hot air on the front surface of the knob base 17 located on the right. These marks 25, 26 are formed on the knob base 17 by means of laser beam machining and have a property of light transmission.

As shown in FIG. 2, there is provided a light guide 27 at the rear of the printed wiring board 12 in the cover 11. As shown in FIG. 4, there are provided openings for illumination at the rear of the marks 25, 26 on the printed wiring board 12. In the light guide 27, there are provided protrusions 27*a* at the rear of the openings 12*b* for illumination.

As shown in FIG. 2, there are provided a plurality of lamps 28 on the rear surface of the printed wiring board 12. These lamps 28 are positioned in the light guide 27. When the plurality of lamps 28 are supplied with electricity by the controlling operation of the ECU, light is emitted from the protrusions 27*a* so that the marks 25, 26 can be illuminated via the openings 12*b* for illumination.

As shown in FIG. 5, an indicator lens 29*a* to 29*f* is embedded at a front end portion on a circumferential wall of each knob dial 18. These indicator lenses 29*a* to 29*f* correspond to the display sections. LEDs 15*a* to 15*e* are positioned at the rear of the indicator lenses 29*a* to 29*f*, that is, LEDs 15*a* to 15*e* are positioned on the locus of rotation. Therefore, as shown in FIG. 1, under the condition that the knob dials 18 are positioned, five predetermined indicator lenses in the indicator lenses 29*a* to 29*f* are opposed to LEDs 15*a* to 15*e*. In this connection, the indicator lenses 29*a* to 29*f* are formed on the knob dials 18 by means of two color formation.

As shown in FIG. 5, there are provided six light paths 30 on the circumferential wall of each knob dial 18. Each light path 30 connects a light entrance 30*a*, which is open via a rear surface of the knob dial 18, with a light exit 30*b* which is communicated with the indicator lens 29*a* to 29*f*. Each light path 30 is formed into a sector-shape in which width is gradually extended from the light exit 30*b* to the light entrance 30*a*. In this connection, reference numeral 30*c* is a light shielding wall section located between the light paths 30.

Under the condition that a position of each knob dial 18 is regulated, each light shielding wall section 30*c* is opposed to a partition wall 13*a* of the holder 13. Accordingly, a beam of light projected from a predetermined LED 15*a* to 15*e* passes through the light entrance 30*a* and the light exit 30*b* and is supplied to a predetermined indicator lens 29*a* to 29*f*. Due to the foregoing, the predetermined indicator lens 29*a* to 29*f* emits light. Therefore, a plurality of marks 25, 26 are selectively indicated. In accordance with that, a hot air blowing position and a quantity of hot air to be blown out by the knob dial are informed to a driver.

As shown in FIG. 3, on the front surface of the printed wiring board 12, there are provided second detection circuit patterns $\mathbf{31}_{a1}$, $\mathbf{31}_{a2}$ to $\mathbf{31}_{e1}$, $\mathbf{31}_{e2}$ which are located on an inner circumference of the first detection circuit patterns 24*a* to 24*e*. Under the condition that a position of each knob dial 18 is regulated, the contact point 23*d* of the contact 23 is located in a gap between the detection circuit patterns $\mathbf{31}_{a1}$, $\mathbf{31}_{a2}$ to $\mathbf{31}_{e1}$, $\mathbf{31}_{e2}$ as shown by two-dotted chain lines.

Accordingly, when each knob dial 18 is rotated for operation, the contact point 23*d* of the contact 23 comes into contact with the detection circuit pattern $\mathbf{31}_{a1}$, $\mathbf{31}_{a2}$ to $\mathbf{31}_{e1}$, $\mathbf{31}_{e2}$ according to the rotational direction of the knob dial 18. Therefore, the detection circuit pattern $\mathbf{31}_{a1}$, $\mathbf{31}_{a2}$ to $\mathbf{31}_{e1}$, $\mathbf{31}_{e2}$ can be selectively continued to the common circuit pattern 14. Then, as described later, the ECU judges a rotational direction of each knob dial 18 according to the detection circuit pattern $\mathbf{31}_{a1}$, $\mathbf{31}_{a2}$ to $\mathbf{31}_{e1}$, $\mathbf{31}_{e2}$ from which a continuity signal has been outputted.

The bezel 32 shown in FIG. 4 is made of synthetic resin. As shown in FIG. 2, a plurality of engaging holes 32*a* are formed on a side plate of the bezel 32. In this case, only one engaging hole 32*a* is illustrated in the drawing. A plurality of claws 11*a* are integrally formed on a side plate of the cover 11. In this case, only one claw 11*a* is illustrated in the drawing. When the bezel 32 is pushed onto the outside of the cover 11, each engaging hole 32*a* is engaged with the claw 11*a*, so that the bezel 32 can be attached to the cover 11, and the front surface of the printed wiring board 12 is covered with the bezel 32.

In this connection, as shown in FIG. 4, there are formed two circular openings 32*b* in the bezel 32. As shown in FIG. 2, each knob dial 18 protrudes from the opening 32*b* onto the front surface side.

As shown in FIG. 4, on the front surface of the printed wiring board 12, there is provided a base 33 which is arranged between holders 13, 13. In the uppermost portion of this base 33, there are provided rubber contact points 34*a*, 34*b* to turn on and off the defrosting mode in which controlled air is blown out onto a windshield. In the middle portion of this base 33, there are provided rubber contact points 34*a*, 34*b* to turn on and off the REC mode in which air is circulated in a chamber. In the lowermost portion of this base 33, there are provided rubber contact points 34*a*, 34*b* to turn on and off an air conditioner.

In the bezel 32, there is formed a rectangular opening 32*c*. Into this rectangular opening 32*c*, three operation knobs 35 are attached as shown in FIG. 1. When each knob 35 is pushed for operation, an ON-signal is outputted from the rubber contact points 34*a* and 34*b*.

Each operation knob 35 is provided with an indicator lens 35*a*. As shown in FIG. 2, on the printed wiring board 12, there is provided an LED 35*b* which is arranged in each operation knob 35. According to the operating condition of the operation knob 35, the ECU turns on and off LED 35*b*, so that each indicator lens 35*a* can be turned on and off. Therefore, a driver is informed of the operating condition (defrosting mode, REC mode and setting condition of the air conditioner) of each operation knob 35. As shown in FIG. 1, on the right of the bezel 32, there is provided a knob dial 36 which is pivotally attached. According to a rotational position of the knob dial 36, the ECU adjusts the temperature of controlled air.

In the bezel 32, there is provided an operation key 36*a* which is arranged inside the knob dial 36. When the ECU detects an operation in which the operation key 36*a* is pushed, the automatic control mode is turned on and off. In the automatic control mode, a blowing position of controlled air and a quantity of controlled air can be automatically changed over. At the same time, when electricity is selectively supplied to LED 15*a* to 15*e* irrespective of the rotational position of each knob dial 18, light is emitted from a predetermined indicator lens 29*a* to 29*f* via the light entrance 30*a* and light exit 30*b*. Due to the foregoing, a changeover condition in which a position of blowing air and a quantity of blowing air are changed over can be informed to a driver.

In the bezel 32, there are provided panels 37*a* and 37*b*. On the panels 37*a* and 37*b*, there are respectively provided indicator lenses 38*a* and 38*b*. When a LED (not shown) is turned on and off by the ECU, the indicator lenses 38*a*, 38*b* are turned on and off. Therefore, the operating condition (setting condition of the automatic control mode) of the operation key 36*a* can be informed to the driver.

Next, the action of the above arrangement will be explained below. After the automatic control mode of an air blowing position and the automatic control mode of a quantity of controlled air have been turned off, each knob dial 18 is rotated for operation. Due to the above operation, the ECU controls such that electricity can be supplied to LED 15*a* to 15*e* according to the rotational position of each knob dial 18 and a predetermined indicator 29*a* to 29*f* can be turned on. In accordance with that, a plurality of marks 25, 26 are selectively indicated. Due to the foregoing, the driver is informed of a rotational condition (hot air blowing position and quantity of hot air) of each knob dial 18.

At the same time, while electricity is being supplied to LED 15*a* to 15*e* according to the rotational position of the knob dial 18, electricity is supplied to an adjacent LED 15*a* to 15*e* in the rotational direction of the knob dial 18. Due to the foregoing, the rotational direction of the knob dial 18 is informed to the driver.

For example, as shown by two-dotted chain lines in FIG. 3, before the operation of each knob dial 18, the contact point 23*c* of each contact 23 comes into contact with the first detection circuit pattern 24*c*. Under the above condition, the detecting circuit pattern 24*c* and the common circuit pattern 14 are electrically continued to each other. Therefore, a continuation signal is outputted from the detecting circuit pattern 24*c*. Accordingly, when the ECU conducts controls such that electricity can be supplied to LED 15*c* in FIG. 1, a beam of light is supplied to the indicator lens 29*c* via the light entrance 30 and the light exit 30*b*, and light is emitted from the indicator lens 29*c*.

When the knob dial 18 is rotated for operation in the direction of arrow A under the above condition, the contact point 23*d* of the contact 23 comes into contact with the second detecting circuit pattern $\mathbf{31}_{a2}$ in FIG. 3, and a continuity signal is outputted from the second detecting circuit pattern $\mathbf{31}_{a2}$. Then, the ECU determines that a rotational operation in which the knob dial 18 is rotated in the direction of arrow A has been started. Therefore, electricity is supplied to LED 15*d* which is adjacent to LED 15*c* in the direction of arrow A, and LED 15*c* and LED 15*d* are simultaneously turned on.

When LED 15*c* and LED 15*d* are turned on, a beam of projection light sent from LED 15*c* is supplied to the indicator lens 29*c* via the light entrance 30*a* and the light exit 30*b*. Therefore, the light emitting condition of the indicator lens 29*c* can be kept. At the same time, a beam of projection light sent from LED 15*d* is supplied to the indicator lens 29*d* via the light entrance 30*a* and the light exit 30*b*. Therefore, light is emitted from the indicator lens 29*d*.

After that, the contact point 23*c* of the contact 23 comes into contact with the first detecting circuit pattern 24*d* in FIG. 3, and a continuity signal is outputted from the first detecting circuit pattern 24*d*. Then, the ECU turns off LED 15*c* in FIG. 1. Then, a beam of projection light sent from LED 15*d* is supplied to the indicator lens 29*c* via the light entrance 30*a* and the light exit 30*b*. Therefore, only the indicator lens 29*c* emits light.

In the above embodiment, when the leaf spring 22 is engaged with three surfaces of the cylindrical section 17*a*, the rotation of the knob dial 18 is regulated. Therefore, when the knob dial 18 is operated and the leaf spring 22 is rotated, the leaf spring 22 is pushed by three corners of the cylindrical section 17*a* and bent in the same direction as that of pushing. For the above reasons, the rotational resistance of the knob dial 18 is reduced, and the operation feeling of the knob dial 18 becomes light. It is possible to prevent the operation feeling from growing heavy especially at an intermediate position.

In this embodiment, the light path 30 is formed into a sector-shape in which width of the light path 30 is extended from the light exit 30*b* to the light entrance 30*a*. Therefore, even when the knob dial 18 is set at an intermediate position, that is, even when the position of the knob dial 18 is not regulated, a beam of projection light sent from LED 15*a* to 15*e* is projected into the light entrance 30*a* except for an instant at which the light shielding wall section 30*c* is opposed to LED 15*a* to 15*e*. Then, the beam of projection light is supplied to the indicator lens 29*a* to 29*f* via the light path 30. Therefore, the indicator lens 29*a* to 29*f* can be illuminated to the utmost.

When the rotational operation of the knob dial 18 is started, while electricity is being supplied to LED 15*a* to 15*e* according to the rotational position of the knob dial 18, LED 15*a* to 15*e* adjacent to it in the rotational direction of the knob dial 19 is supplied with electricity. Therefore, the rotational direction of the knob dial 18 is informed to a driver, and the dial operation device becomes more handy.

Figure 6:
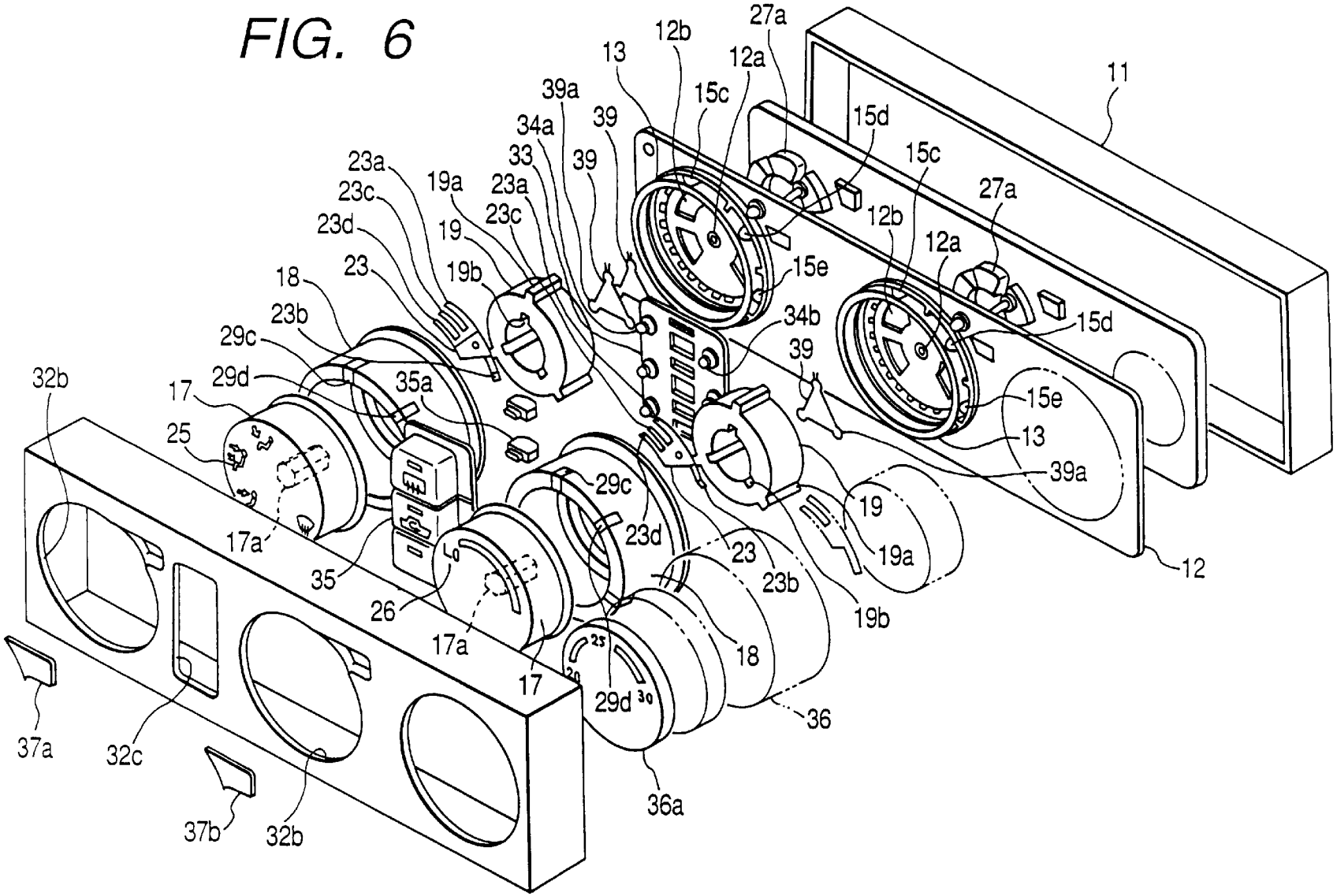
FIG. 6 is a view showing a second embodiment of the present invention which corresponds to FIG. 4.
Figure 7:
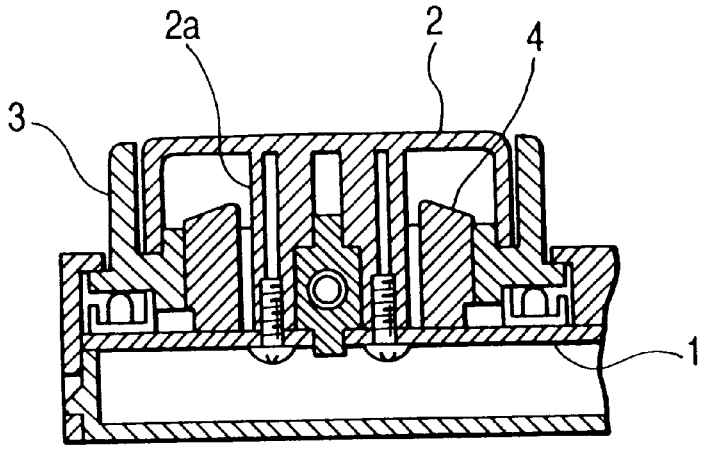
FIG. 7 is a transversely cross-sectional view showing the conventional example.
Figure 8:
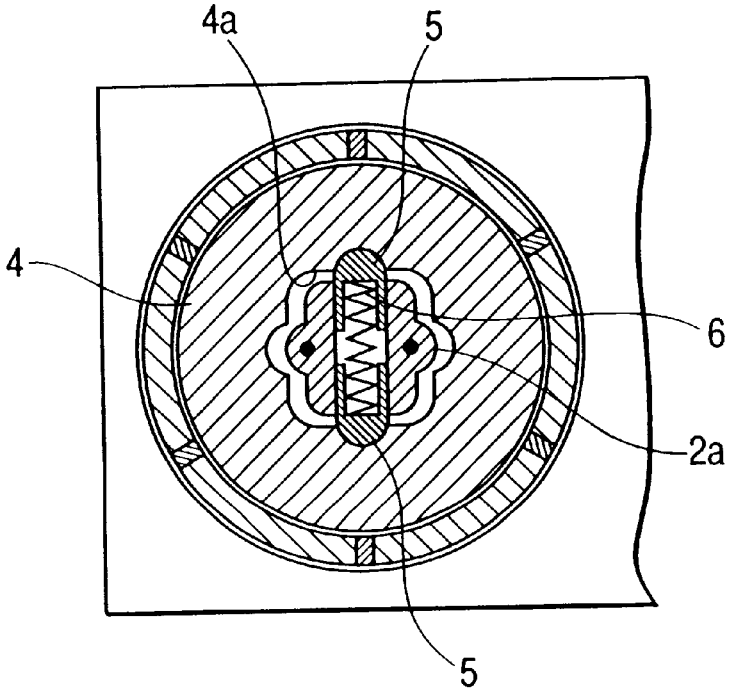
FIG. 8 is a front surface view showing the conventional example.

Next, referring to FIG. 6, the second embodiment of the present invention will be explained below. In this connection, like reference characters are used to indicate like parts in the first and the second embodiment, and the explanations are omitted here. Only parts of the second embodiment different from the first embodiment will be explained as follows. In the knob body 19 arranged on the left, there are provided two wire springs 39 which correspond to spring members. In the knob body 19 arranged on the right, there is provided one wire spring 39 which corresponds to a spring member.

Each wire spring 39 described above is bent into a triangle. In each wire spring 39, there are formed three engaging sections 39*a*. Each engaging section 39*a* is inserted into a groove 19*b* of the knob body 19. Rotation of the knob dial 18 arranged on the left is regulated when two wire springs 39 are engaged with three surfaces of the cylindrical section 17*a*. Rotation of the knob dial 18 arranged on the right is regulated when one wire spring 39 is engaged with three surfaces of the cylindrical section 17*a*.

In the above embodiment, when the knob dial 18 arranged on the left is rotated for operation, two wire springs 39 are rotated. Then, the wire springs 39 are pushed against three corners of the cylindrical section 17*a* and deflected. After that, when three corners of the cylindrical section 17*a* get over the wire springs 39 and three new surfaces are engaged with two wire springs 39, rotation of the knob dial 18 is regulated. Due to the foregoing, rotational resistance of the knob dial 18 is reduced. Accordingly, a feeling of operation of the knob dial 18 becomes light, and rotation of the knob dial 18 is prevented from stopping in the middle of operation. Further, different from the first embodiment in which the leaf spring 22 is used as a spring member, the wire spring 39 is used in the second embodiment. Therefore, height of the knob dial 18 can be decreased.

When the knob dial 18 arranged on the right is rotated, one wire spring 39 is rotated. Then, the wire spring 39 is pushed against three corners of the cylindrical section 17*a* and deflected. After that, when three corners of the cylindrical section 17*a* get over the wire springs 39 and three new surfaces are engaged with the wire spring 39, rotation of the knob dial 18 is regulated. Due to the foregoing, rotational resistance of the knob dial 18 is reduced. Accordingly, a feeling of operation of the knob dial 18 becomes light, and rotation of the knob dial 18 is prevented from stopping in the middle of operation. Further, since the wire spring 39 is used as a spring member, height of the knob dial 18 can be decreased.

Two wire springs 39 are used for the knob dial 18 arranged on the left, and one wire spring 39 is used for knob dial 18 arranged on the right. Therefore, the intensity of the knob dial 19 arranged on the left is different from the intensity of the knob dial 18 arranged on the right. Accordingly, it is possible for a driver to distinguish between the two knob dials 18 by the feeling of operation. Therefore, the operation property of the knob dial 18 can be enhanced.

In this connection, in order to make the intensity of the knob dial 18 arranged on the left to be different from the intensity of the knob dial 18 arranged on the right in the first embodiment described before, it is necessary to adjust a spring force by changing heights of both leaf springs 22. Therefore, it is necessary to carefully distinguish between both leaf springs 22 so as to attach them to the knob dials 18, which takes labor and time.

In order to improve the above circumstances, the wire springs 39, the numbers of which are different from each other, are used for both knob dials 18. Therefore, it is unnecessary to carefully distinguish between both leaf springs 22 when they are attached to the knob dials 18. Accordingly, the assembling property can be enhanced. Unlike a case in which the leaf springs 22 of different types are manufactured, only one type wire spring 39 is used in this embodiment. Therefore, this embodiment is advantageous in that the number of parts can be reduced.

In the above second embodiment, two wire springs 39 are accommodated in the knob body 19 arranged on the left, and one wire spring 39 is accommodated in the knob body 19 arranged on the right. However, it should be noted that the present invention is not limited to the above specific embodiment. The number of the wire springs 39 may be adjusted if necessary.

In the above second embodiment, wire springs 39 are accommodated in both knob bodies 19. However, it should be noted that the present invention is not limited to the above specific embodiment. For example, when both the leaf spring 22 and the wire spring 39 are accommodated, intensities of forces to operate both knob dials 18 may be adjusted.

In the above first and the second embodiment, the second detection circuit patterns $\mathbf{31}_{a1}$, $\mathbf{31}_{a2}$ to $\mathbf{31}_{e1}$, $\mathbf{31}_{e2}$ for detecting the rotational directions of the knob dials 18 are formed on the printed wiring board 12. However, it should be noted that the present invention is not limited to the above specific embodiment. For example, the second detection circuit patterns $\mathbf{31}_{a1}$, $\mathbf{31}_{a2}$ to $\mathbf{31}_{e1}$, $\mathbf{31}_{e2}$ may be abolished. In this structure, the contact point of each contact 23 may be also abolished.

In the above first and second embodiment, the cylindrical section 17*a* is fixed to the holder 13, and the leaf spring 22 and the wire spring 39 are rotated integrally with the knob dial 18. However, it should be noted that the present invention is not limited to the above specific embodiment. For example, the leaf spring 22 or the wire spring 39 may be fixed to the holder 13, and the cylindrical section 17*a* may be rotated integrally with the knob dial 18.

In the above first and second embodiment, the cylindrical section 17*a*, the cross-section of which is hexagonal, the triangular leaf spring 22 and the wire spring 39 are used and three surfaces of the cylindrical section 17*a* are engaged with the leaf spring 22 and the wire spring 39. However, it should be noted that the present invention is not limited to the above specific embodiment. For example, a linear leaf spring and wire spring may be used, and one surface of the cylindrical section 17*a* may be engaged with the leaf spring and the wire spring.

In the above first and second embodiment, a rotational position of the knob dial 18 is regulated at the regular interval of 60°. However, it should be noted that the present invention is not limited to the above specific embodiment. For example, a rotational position of the knob dial 18 may be regulated at the regular interval of 30°. In this structure, a cross-section of the cylindrical section 17*a* may be formed into a dodecagon, and the leaf spring 22 and the wire spring 39 may be formed into hexagons.

In the above first and the second embodiment, the present invention is applied to a heater controller of an automobile. However, it should be noted that the present invention is not limited to the above specific embodiment. The essential point is that the present invention can be applied to all dial operation devices having rotational knob dials.

As can be seen in the above explanations, the dial operation device of the present invention can provide the following effects.

According to the means described in claim 1, when the leaf spring is pushed in the direction of deflection, a feeling of moderation is provided. Therefore, the rotational resistance of the knob dial is reduced. Accordingly, it is possible to prevent a feeling of operation from growing heavy especially at an intermediate position.

According to the means described in claim 2, when the wire spring is pushed in the direction of deflection, a feeling of moderation is provided. Therefore, it is possible to reduce the height of the knob dial. At the same time, the rotational resistance of the knob dial can be reduced. Accordingly, a feeling of operation becomes light, and it is possible to prevent a feeling of operation from growing heavy especially at an intermediate position.

According to the means described in claim 3, when the wire spring is pushed in the direction of deflection, a feeling of moderation is provided. Therefore, height of the knob dial can be reduced, and a feeling of operation can be made light. Further, intensities of forces of operation of a plurality of knob dials are made to be different from each other. Accordingly, a plurality of knob dials can be easily distinguished from each other by a feeling of operation. Further, it is unnecessary to carefully distinguish the spring members, the profiles of which are delicately different from each other, so as to attach them to different knob dials. Consequently, the assembling property can be enhanced. Furthermore, the number of types of wire springs can be reduced in this structure. Therefore, the number of parts can be reduced.

What is claimed is:

1. A dial operation device comprising:

a knob dial to be rotated for operation;

a moderation member; and a spring member, wherein the moderation member and the spring member are rotated relative to each other in accordance with the rotation of the knob dial, wherein a cross-section of the moderation member is polygonal, and the spring member is composed of a leaf spring for regulating the rotation of the knob dial when the spring member is engaged with at least three surfaces of the moderation member.

2. A dial operation device comprising:

a knob dial to be rotated for operation;

a moderation member to be rotated relative to a spring member, wherein one of the moderation member and the spring member remains in a fixed position, and the other is integral to the knob dial, and wherein a cross-section of the moderation member is polygonal, and the spring member is composed of a wire spring for regulating the rotation of the knob dial when the spring member is engaged with at least three surfaces of the moderation member.

3. The apparatus according to claim 2, wherein the moderation member is fixed and the spring member is integral to the knob dial.

4. A dial operation device comprising:

a plurality of knob dials to be rotated for operation; each of said knob dials accommodating a moderation member and at least one corresponding spring member, wherein one of said moderation member or said at least one corresponding spring member remains in a fixed position, and the other is integral to the knob dial, and wherein cross-sections of the moderation members are polygonal, and the spring members are composed of wire springs, the numbers of said spring members accommodated within each of said knob dials are different from each other, for regulating the rotation of the knob dials when the spring members are engaged with at least one surface of the moderation members.

* * * * *